US011173380B2

(12) United States Patent
Stelzer

(10) Patent No.: US 11,173,380 B2
(45) Date of Patent: Nov. 16, 2021

(54) FRONT UNIT OF A TOURING SKI BINDING WITH A MOUNTING ARRANGEMENT FOR CRAMPONS

(71) Applicant: Salewa Sport AG, Denges (CH)

(72) Inventor: Christopher Stelzer, Kirchheim bei München (DE)

(73) Assignee: SALEWA SPORT AG, Denges (CH)

( * ) Notice: Subject to any disclaimer, the term of this patent is extended or adjusted under 35 U.S.C. 154(b) by 29 days.

(21) Appl. No.: 16/831,438

(22) Filed: Mar. 26, 2020

(65) Prior Publication Data

US 2020/0324187 A1 Oct. 15, 2020

(30) Foreign Application Priority Data

Mar. 27, 2019 (DE) ..... 10 2019 204 292.9

(51) Int. Cl.
*A63C 9/00* (2012.01)
*A63C 11/00* (2006.01)

(52) U.S. Cl.
CPC ..... *A63C 9/00* (2013.01); *A63C 11/00* (2013.01)

(58) Field of Classification Search
CPC ..... A63C 9/00; A63C 9/006; A63C 11/00
See application file for complete search history.

(56) References Cited

U.S. PATENT DOCUMENTS 8,033,564 B2 * 10/2011 Riepler ..... A63C 5/03 280/603
2003/0061740 A1 * 4/2003 Dodge ..... A43C 15/061 36/122
2003/0075901 A1 * 4/2003 Long ..... A63C 11/00 280/604
2009/0179403 A1 * 7/2009 Ekberg ..... A63C 7/005 280/623
2012/0274036 A1 * 11/2012 Kloster ..... A63C 5/0411 280/11.31

(Continued)

FOREIGN PATENT DOCUMENTS

EP 2327457 A2 6/2011

OTHER PUBLICATIONS

European Patent Application No. EP10 2019 204 292.9, European Search Report dated Dec. 4, 2019, 7 pages.

*Primary Examiner* — Brian L Swenson
(74) *Attorney, Agent, or Firm* — Kilpatrick Townsend & Stockton LLP

(57) ABSTRACT

A fastening assembly for a ski crampon includes a hinge pin having a mounting portion and a securing portion. The mounting portion has a smaller dimension in a first direction and a larger dimension in a second direction, the first and second directions orthogonal to the longitudinal direction of the hinge pin. The securing portion has substantially the same dimension in the first and second directions. A mounting fastening portion defines a gap and an opening. The gap and the opening each extends substantially transversely to a ski longitudinal direction and substantially parallel to the ski surface. The gap receives the mounting portion of the hinge pin, which is inserted through the opening. The dimension of the opening in the ski longitudinal direction is larger than the dimension of the mounting portion in the first direction and smaller than the dimension of the mounting portion in the second direction.

22 Claims, 5 Drawing Sheets

(56) References Cited

U.S. PATENT DOCUMENTS

Figure 1A:
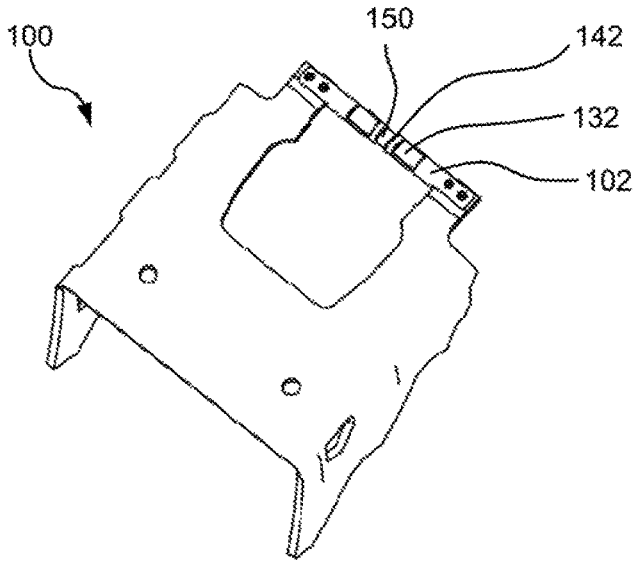

| | | | | |
|---|---|---|---|---|
| 2016/0199722 | A1* | 7/2016 | Ritter | A63C 7/12<br>280/617 |
| 2017/0189788 | A1* | 7/2017 | Wariakois | A63C 10/14 |

* cited by examiner

FRONT UNIT OF A TOURING SKI BINDING WITH A MOUNTING ARRANGEMENT FOR CRAMPONS

CROSS REFERENCE TO RELATED APPLICATION

This application claims priority to German Patent Application No. 10 2019 204 292.9, filed in Germany on Mar. 27, 2019, the entire contents of which are hereby incorporated herein by this reference.

The present invention relates to a fastening assembly for a crampon that is to be coupled to a ski, comprising a hinge pin which comprises at least one mounting portion, in a longitudinal direction of the hinge pin, having a smaller dimension in a first direction orthogonal to the longitudinal direction, and a larger dimension in a second direction orthogonal to the longitudinal direction, as well as a securing portion having substantially the same dimension in the first and in the second direction, the fastening assembly comprising at least one mounting fastening portion defining a gap which extends in a direction extending substantially transversely to a ski longitudinal direction and so as to be substantially in parallel with a ski surface, and which is intended for receiving the mounting portion of the hinge pin, and defining an opening which extends in a direction extending substantially transversely to a ski longitudinal direction and so as to be substantially in parallel with a ski surface, and which is intended for insertion of the mounting portion of the hinge pin through the opening, the dimension in the ski longitudinal direction of the opening of the mounting fastening portion being larger than the dimension of the mounting portion of the hinge pin in the first direction, and smaller than the dimension of the mounting portion of the hinge pin in the second direction, Such fastening assemblies for crampons can be more easily coupled to a crampon than is the case for example for fastening assemblies of different designs, in which the crampon must be inserted laterally into a crampon tongue for example. The predefined dimensions of the portions and openings result, in the region of the mounting portion, in a region on the hinge pin that is flattened in the first direction and which typically has a circular cross section over the remainder of the extension thereof. Since the dimension of the opening of the mounting fastening portion is larger than that of the flattened region of the hinge pin, in order to receive the crampon on the fastening assembly, the hinge pin of said crampon can be inserted through the opening in the gap of the mounting fastening portion and, in this manner, mounted on a ski to which the fastening assembly is fastened, if the hinge pin is retained such that the first direction substantially corresponds to the ski longitudinal direction, i.e. the hinge pin is rotated such that the flattened region of the mounting portion of the hinge pin passes through the opening of the mounting fastening portion. If the crampon is then pivoted about the longitudinal axis of the hinge pin, owing to the larger dimension of the hinge pin in the second direction the crampon is retained pivotably on the ski and can be removed therefrom only if the crampon is pivoted back into the position in which it was mounted. In this position, the crampon can be removed from the gap, through the opening of the mounting fastening portion, substantially without force.

Precisely this, however, can be a problem if a ski mountaineer wishes to carry his skis having crampons mounted thereon. Skis are often carried by being clamped together and laid over the shoulder. In this case, the crampon can move into the position in which the hinge pin can be removed from the gap, through the opening of the mounting fastening portion, without force, since, on the ski that has its upper face pointing downwards, the mounted crampon pivots about the hinge pin. In a particular angular position, the flattened region of the mounting portion of the hinge pin can fall out, through the opening of the mounting fastening portion, and the ski mountaineer may lose the crampon. In particular if steeper slopes are crossed, a crampon falling out can also slip such that it comes to rest in terrain that is unreachable for the ski mountaineer, resulting in loss of the crampon. If the crampon falls into deep snow, too, it is possible that the ski mountaineer may no longer be able to find the crampon.

Against this background, an object of the present invention is that of a fastening assembly for a crampon that is to be coupled to a ski, which fastening assembly ensures simple mounting as well as secure retention of the crampon, and which additionally acts against loss of the crampon.

According to a first aspect of the invention this object is achieved by a fastening assembly for a crampon that is to be coupled to a ski, comprising a hinge pin which comprises at least one mounting portion, in a longitudinal direction of the hinge pin, having a smaller dimension in a first direction orthogonal to the longitudinal direction, and a larger dimension in a second direction orthogonal to the longitudinal direction, as well as a securing portion having substantially the same dimension in the first and in the second direction, the fastening assembly comprising at least one mounting fastening portion defining a gap which extends in a direction extending substantially transversely to a ski longitudinal direction and so as to be substantially in parallel with a ski surface, and which is intended for receiving the mounting portion of the hinge pin, and defining an opening which extends in a direction extending substantially transversely to a ski longitudinal direction and so as to be substantially in parallel with a ski surface, and which is intended for insertion of the mounting portion of the hinge pin through the opening, the dimension in the ski longitudinal direction of the opening of the mounting fastening portion being larger than the dimension of the mounting portion of the hinge pin in the first direction, and smaller than the dimension of the mounting portion of the hinge pin in the second direction, the fastening assembly further comprising at least one securing fastening portion defining a gap which extends in a direction extending substantially transversely to a ski longitudinal direction and so as to be substantially in parallel with a ski surface, and which is intended for receiving the securing portion of the hinge pin, and defining an opening which extends in a direction extending substantially transversely to a ski longitudinal direction and so as to be substantially in parallel with a ski surface, and which is intended for insertion of the securing portion of the hinge pin through the opening, the at least one securing fastening portion being resiliently yielding at least in part, and the dimension in the ski longitudinal direction of the opening of the securing fastening portion being smaller than the dimension of the securing portion of the hinge pin.

The fastening assembly can be coupled to a front unit of a touring ski binding mounted on the ski, or can be mounted directly on the ski, separately from the touring ski binding, for example screwed to a ski surface or otherwise fastened thereto.

In this case, the dimension of the opening of the securing fastening portion is designed such that the securing portion of the hinge pin can be inserted into the gap of the securing fastening portion, through the opening of the securing fastening portion, by application of force and a resulting deformation of the at least one resiliently yielding securing fastening portion, removal of the securing portion from the gap of the securing fastening portion, through the opening of the securing fastening portion, substantially without force is prevented, and removal of the securing portion of the hinge pin from the gap, through the opening of the securing fastening portion, is admissible only by application of force and a resulting deformation of the at least one resiliently yielding securing fastening portion. As a result, it is in turn possible to prevent, in a particularly simple manner, a ski mountaineer from losing his crampon mounted on the ski when carrying the ski together with the mounted crampon, by placing it over his shoulder for example.

The securing fastening portion can for example be a clip-like receptacle for the securing portion of the hinge pin of the crampon.

In a preferred embodiment, the fastening assembly can comprise two mounting fastening portions which are provided on a mounting fastening element. Two mounting fastening portions ensure that tilting of the hinge pin, and thus of the crampon, is prevented. Furthermore, two mounting fastening portions ensure reliable retention of the hinge pin in the receptacle provided by the mounting fastening portions. It is also possible to provide more than two mounting fastening portions.

Furthermore, the fastening assembly can preferably comprise two securing fastening portions which are provided on a securing fastening element. Fastening the hinge pin at two points provides secure retention thereof and additionally impedes loss of the crampon. It is also possible to provide more than two securing fastening portions.

In a further advantageous embodiment, the fastening assembly can furthermore comprise a centring portion which is designed for cooperating with a complementary portion provided on the hinge pin, in order to hold the hinge pin of the crampon in a central position, with respect to a direction extending substantially transversely to a ski longitudinal direction and so as to be substantially in parallel with a ski surface. As a result of the centring portion, the crampon can be held in a central position, with respect to a ski width, in a particularly simple manner. As a result, advantageous force transmission to the prongs of the crampon and reliable fastening of the crampon can be achieved, since the leverage exerted on the fastening portions is kept as small as possible when the crampon is in a central position. An example for centring means of this kind can be a protrusion which cooperates with a notch that is designed so as to be complementary thereto, in order to hold the hinge pin of the crampon in the central position. Vice versa, it is also possible for the centring portion to be designed as a notch and to cooperate with a protrusion that is designed so as to be complementary thereto, in order to hold the hinge pin of the crampon in the central position. Other possibilities for centring the crampon in a central position with respect to the ski width are also conceivable.

In one embodiment of the present invention, the centring portion can be provided on the mounting fastening element. Since the mounting fastening element functions as a receptacle for the hinge pin of the crampon and is in contact therewith, an arrangement of the centring portion on the mounting fastening element can be implemented in a particularly simple manner, and is a reliable option for centring the crampon.

In an alternative, preferred embodiment, the centring portion can be provided on the securing fastening element. Since the mounting fastening element also functions as a receptacle for the hinge pin of the crampon and is in contact therewith, an arrangement of the centring portion on the securing fastening element, as an alternative, can likewise be implemented in a particularly simple manner, and is a reliable option for centring the crampon.

Particularly preferably, the at least one mounting fastening portion can be made of a metal. For example, the at least one mounting fastening portion can be made of a sheet of stainless steel, aluminum or titanium. A metal receptacle for the crampon hinge pin can ensure reliable retention of the crampon on the ski and the necessary stability and rigidity of the fastening assembly.

Furthermore, the at least one securing fastening portion can preferably be made of a plastics material. Plastics materials can ensure elasticity of the securing fastening portion, which is necessary in order that the securing portion of the hinge pin can be inserted into the gap of the securing fastening portion, through the opening of the securing fastening portion, by application of force, and retained in the gap of the securing fastening portion in such a way that it cannot fall out of the gap of the securing fastening portion without application of force, and can be removed from the gap, through the opening of the securing fastening portion, by application of force. In particular polyoxymethylene (POM) can be used as the plastics material for the securing fastening portion, since POM has properties that are favourable for the fields of application of skis and touring ski bindings. In particular at low temperatures, to which skis and ski bindings are very often exposed, POM still has a sufficient degree of resiliency and breaking strength. If the mounting fastening portion is made of a metal, in particular a stainless steel sheet, and the securing fastening portion is made of a plastics material, in particular POM, this material composition provides a favourable combination of properties of metal, which ensures the necessary stability and rigidity of the fastening assembly, and plastics material, which ensures the necessary resiliency of the fastening assembly.

In a further advantageous embodiment, the securing fastening element can be fastened to the mounting fastening element, in particular fastened to the mounting fastening element in an interlocking manner. Alternatively, the securing fastening portion can also be fastened to the base, and the mounting fastening portion can be fastened to the securing fastening portion. As a further alternative it is also possible for both the mounting fastening portion and the securing fastening portion to be fastened to the base.

According to a further aspect of the invention, the object of the invention is achieved by a front unit of a touring ski binding which comprises the fastening assembly according to the first aspect. Coupling or connection of the fastening assembly and a front unit of a touring ski binding is particularly favourable, since separate fastening of the fastening assembly can be omitted and the fastening assembly, together with the front unit, can be assembled to form a module, and can be delivered as an individual module and mounted on a ski.

In a preferred embodiment, the mounting fastening element can comprise at least one fastening means for fastening to a base of the front unit. Fastening the mounting fastening element to the base of the front unit can ensure good force transmission between the crampon and the front unit of the touring ski binding.

The at least one fastening means can be provided in the form of a hook which is designed for extending below and engaging behind a rib provided on the base. As a result of such a shaping of the fastening means, no additional mounting elements, such as screws or the like, are required for fastening the fastening assembly for the crampon to the front unit of the touring ski binding. Furthermore, mounting of the fastening assembly can be brought about in a particularly simple manner by means of a hook-shaped fastening means, in that the fastening assembly is placed on a ski, the front unit is placed on the ski and fastening assembly such that the book-shaped fastening means comes into engagement with a rib provided on the base of the front unit, and the front unit is then fastened to the ski, in particular screwed to the ski, in order to fix the fastening assembly to the ski by means of the base. Alternatively, it is also possible to fasten the fastening assembly by means of binding mounting screws or by means of separately screwing the fastening assembly to the ski.

In an alternative embodiment, the at least one mounting fastening portion can be formed integrally with the front unit, in particular with a base of the front unit. This variant is conceivable in particular if the base of the front unit is made of a material that is also suitable for the mounting fastening portion. In this way, the number of components can be reduced, and binding mounting can be facilitated.

In a further alternative embodiment, the at least one securing fastening portion can be formed integrally with the front unit, in particular with a base of the front unit. This variant is conceivable in particular if the base of the front unit is made of a material that is also suitable for the securing fastening portion. In this way, the number of components can be reduced, and binding mounting can be facilitated.

Furthermore, the front unit can comprise a crampon that comprises a hinge pin which comprises at least one mounting portion, in a longitudinal direction of the hinge pin, having a smaller dimension in a first direction orthogonal to the longitudinal direction, and a larger dimension in a second direction orthogonal to the longitudinal direction, as well as a securing portion having substantially the same dimension in the first and in the second direction. A crampon of this kind can be particularly expediently coupled to the front unit according to the invention, since the individual portions are exactly matched to one another. That is to say that the mounting portion of the hinge pin of the crampon can be received in the mounting fastening portion of the fastening assembly of the front unit in a fitting manner, and the securing portion of the hinge pin of the crampon can be received in the securing fastening portion of the fastening assembly of the front unit in a fitting manner. The dimensions of the portions and openings result, in the region of each mounting portion, in a region on the hinge pin that is flattened in the first direction and which can have in particular a circular cross section over the remainder of the extension thereof. The flattened regions can be achieved for example by recesses, on one or both sides, on the hinge pin. Since the dimension of the opening of the mounting fastening portion is larger than that of the flattened region of the hinge pin, the hinge pin of the crampon can be inserted through the opening in the gap of the mounting fastening portion and, in this manner, mounted on the front unit of the touring ski binding, if the hinge pin is retained such that the first direction substantially corresponds to the ski longitudinal direction, i.e. the hinge pin is rotated such that the flattened region of the mounting portion of the hinge pin passes through the opening of the mounting fastening portion. If the crampon is then pivoted about the longitudinal axis of the hinge pin, owing to the larger dimension of the hinge pin in the second direction, which is larger than the dimension in the ski longitudinal direction of the opening of the mounting fastening portion, the crampon is retained pivotably on the front unit. The dimension of the opening of the securing fastening portion is designed such that the securing portion of the hinge pin can be inserted into the gap of the securing fastening portion, through the opening of the securing fastening portion, by application of force, and removal of the securing portion from the gap of the securing fastening portion through the opening of the securing fastening portion, substantially without force, is prevented. As a result, it is in turn possible to prevent, in a particularly simple manner, a ski mountaineer from losing his crampon mounted on the ski touring binding when carrying the ski together with the mounted crampon, by placing it over his shoulder for example.

Figure 1B:
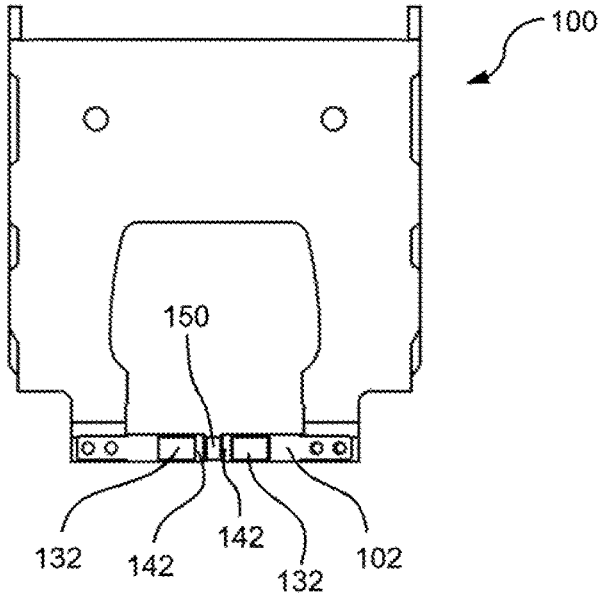
Figure 1C:
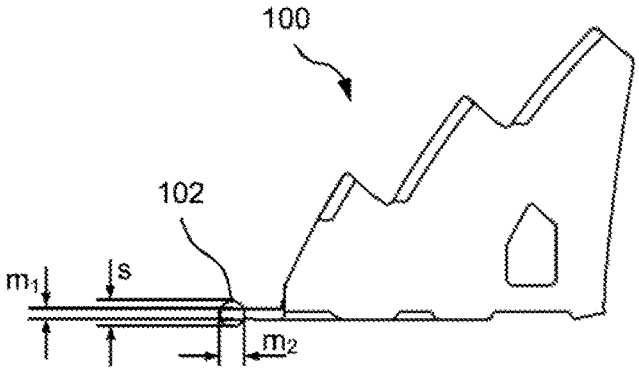
Figure 2A:
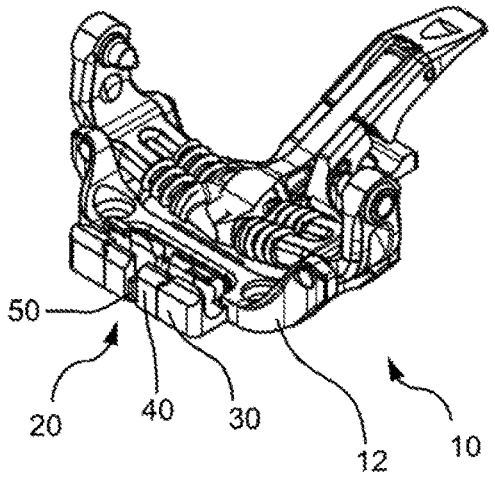
Figure 2B:
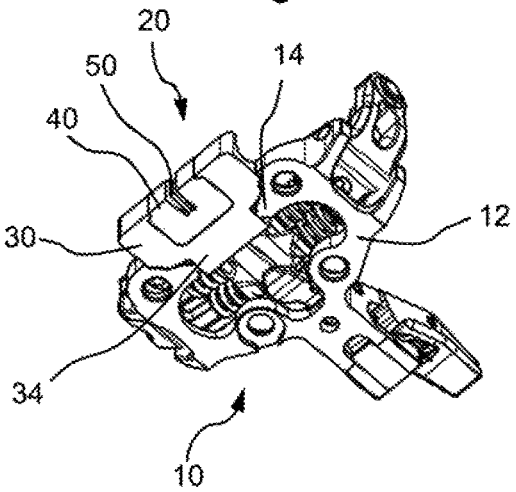
Figure 2C:
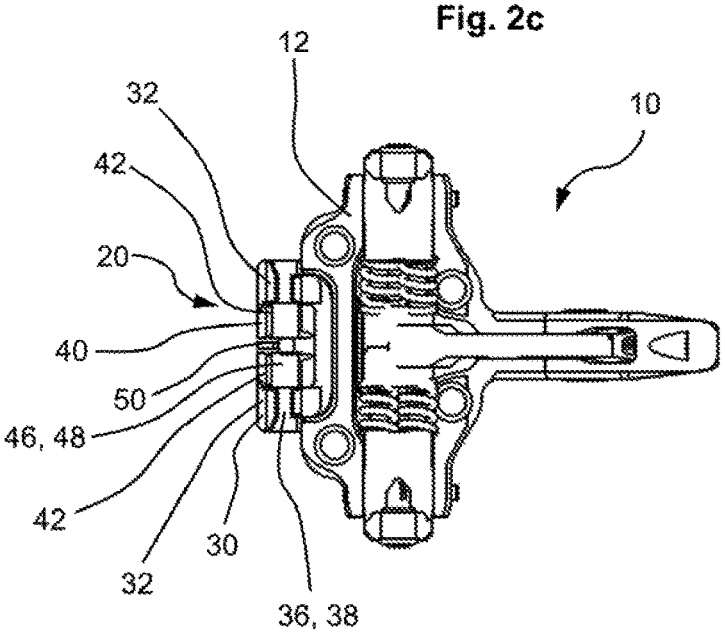
Figure 2D:
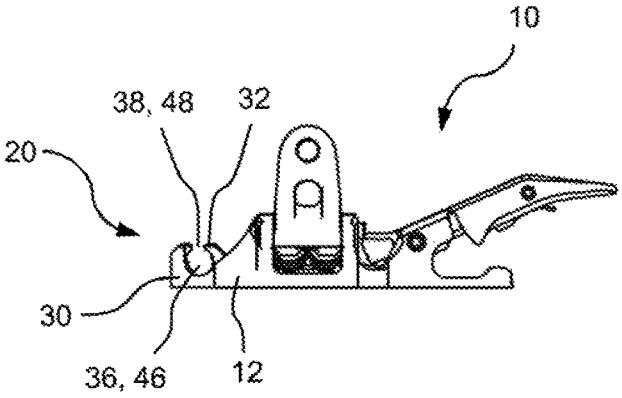
Figure 3A:
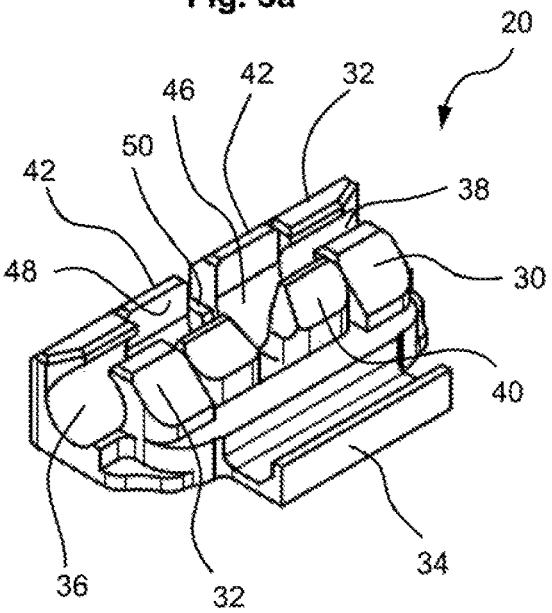
Figure 3B:
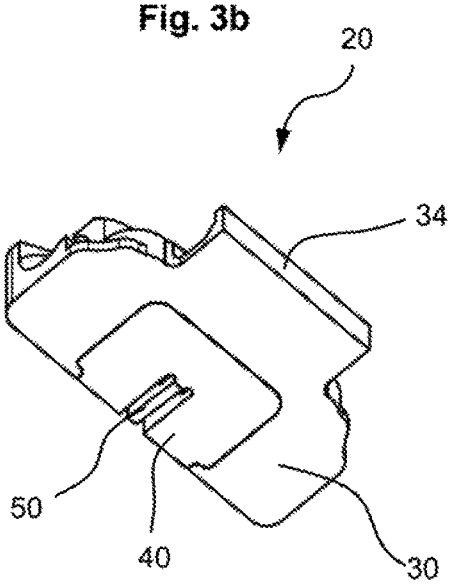
Figure 3C:
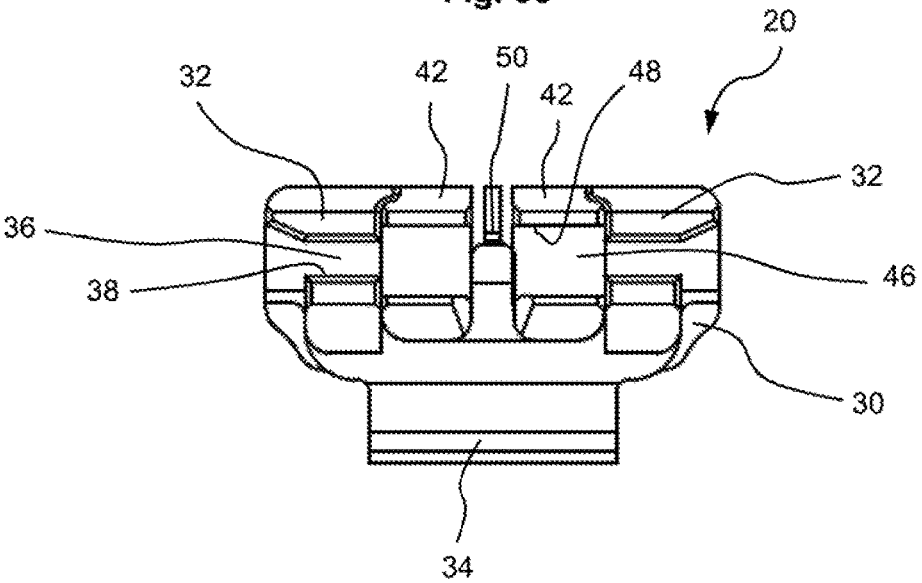
Figure 3D:
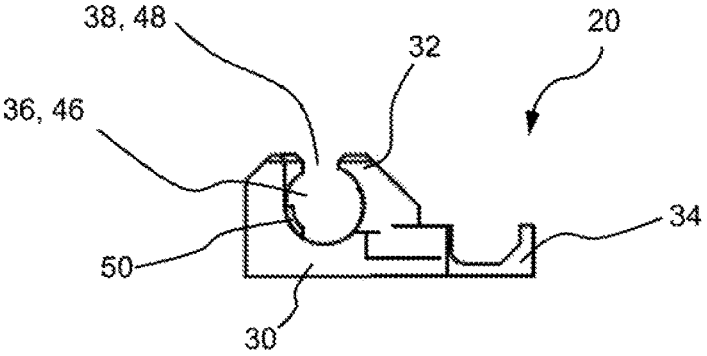
Figure 4A:
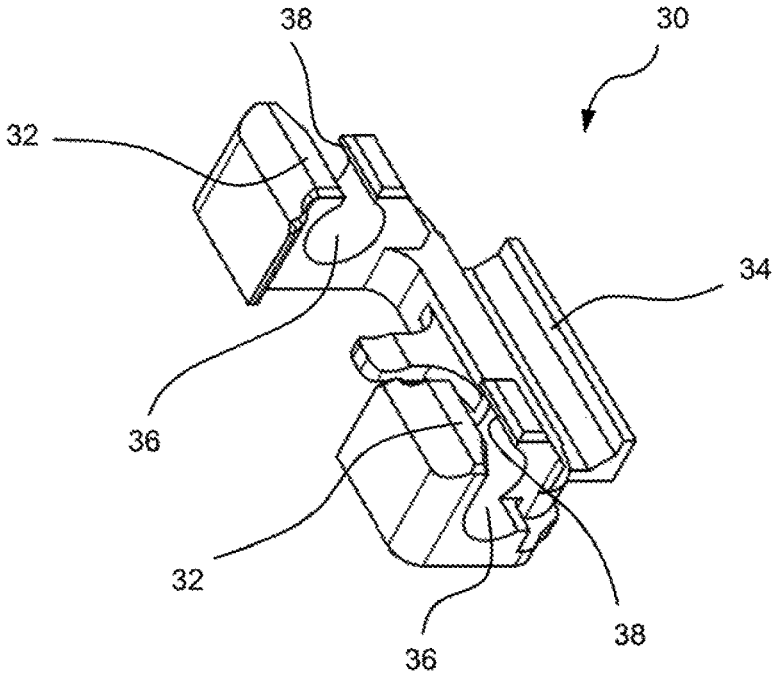
Figure 4B:
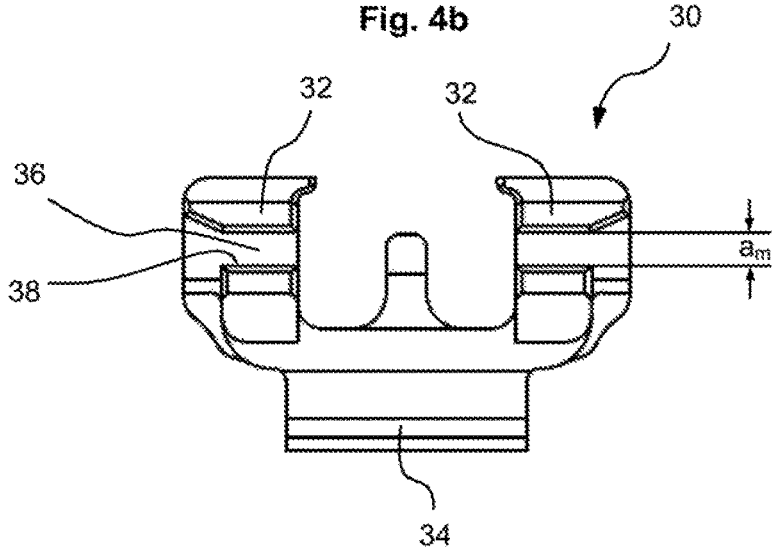
Figure 4C:
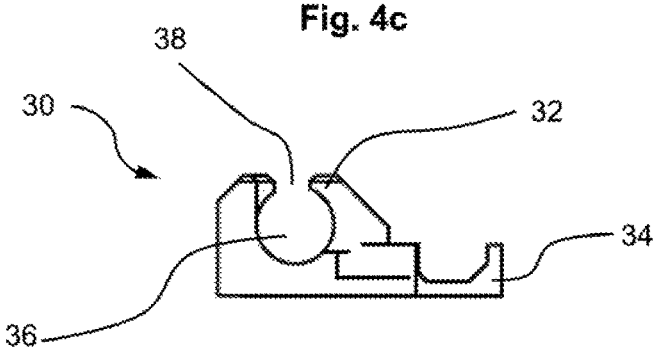
Figure 5A:
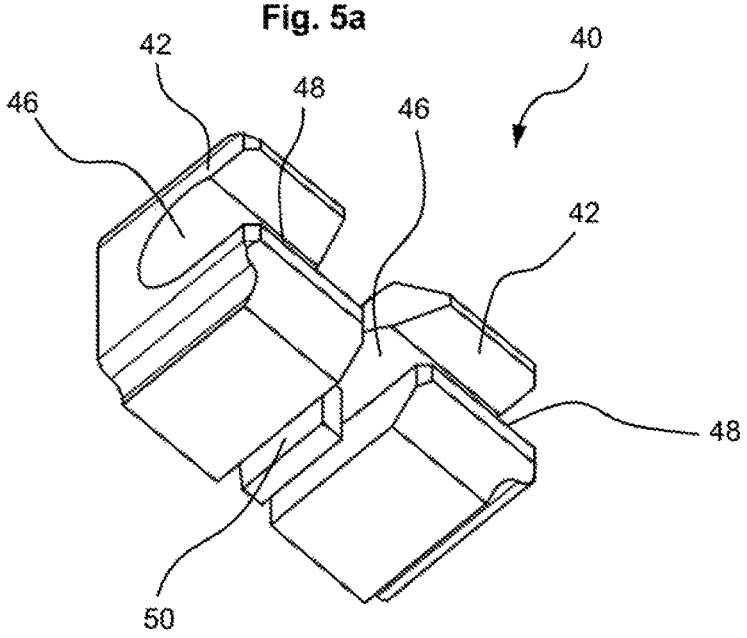
Figure 5B:
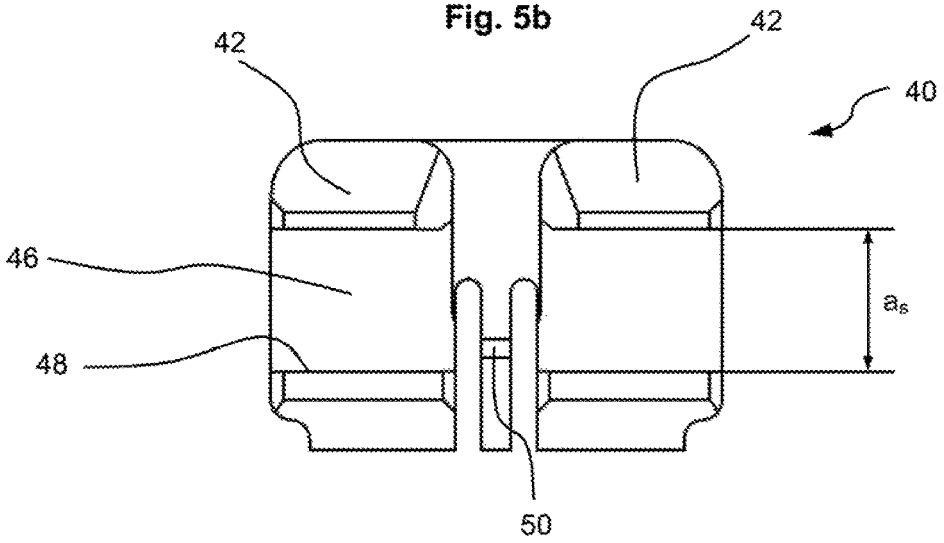
Figure 5C:
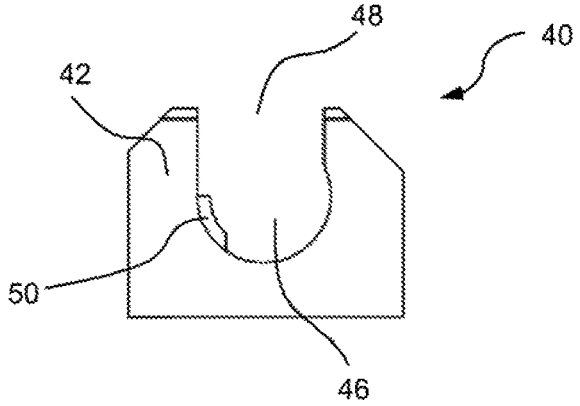

The invention will be explained in greater detail in the following, on the basis of a preferred embodiment and with reference to the accompanying drawings, in which:

FIG. 1*a*: is a perspective view of a crampon that is to be coupled to a fastening assembly according to the embodiment of the present invention;

FIG. 1*b*: is a plan view of the crampon shown in FIG. 1*a*,

FIG. 1*c*: is a side view of the crampon shown in FIGS. 1*a* and 1*b*, FIG. 2*a*: is a perspective view of a front unit according to the embodiment of the present invention that comprises the fastening assembly, FIG. 2*b*: is a further perspective view of the front unit that comprises the fastening assembly and is shown in FIG. 2*a*, FIG. 2*c*: is a plan view of the front unit shown in FIGS. 2*a* and 2*b*, FIG. 2*d*: is a side view of the front unit shown in FIG. 2*a* to 2*c*, FIG. 3*a*: is a perspective view of the fastening assembly according to the embodiment of the present invention, FIG. 3*b*: is a further perspective view of the fastening assembly shown in FIG. 3*a*, FIG. 3*c*: is a plan view of the fastening assembly shown in FIGS. 3*a* and 3*b*, FIG. 3*d*: is a side view of the fastening assembly shown in FIG. 3*a* to 3*c*, FIG. 4*a*: is a perspective view of a mounting fastening element of the fastening assembly according to the embodiment of the present invention, FIG. 4*b*: is a plan view of the mounting fastening element shown in FIG. 4*a*, FIG. 4*c*: is a side view of the mounting fastening element shown in FIGS. 4*a* and 4*b*, FIG. 5*a*: is a perspective view of a securing fastening element of the fastening assembly according to the embodiment of the present invention, FIG. 5*b*: is a plan view of the securing fastening element shown in FIG. 5*a*, and FIG. 5*c*: is a side view of the securing fastening element shown in FIG. 5*a* and 5*b*.

FIG. 1*a* to 1*c* show a crampon 100 that is to be coupled to the fastening assembly 20 according to the embodiment of the invention, FIG. 1*a* being a perspective view of the crampon 100, FIG. 1*b* being a plan view of the crampon 100, and FIG. 1*c* being a side view of the crampon 100.

The crampon 100 comprises a crampon body and a hinge pin 102. The crampon body comprises a support surface for being supported on a ski, and portions laterally angled therefrom, at the ends of which prongs for penetrating into snow or ice are provided. The angled portions can in particular be formed so as to be at an angle of approximately 90° with respect to the support surface. The crampon furthermore comprises the hinge pin 102, by means of which the crampon can be coupled to a fastening assembly 20 according to the invention (FIG. 3*a* to 3*d*). The hinge pin 102 comprises at least one mounting portion 132 and at least one securing portion 142. In the embodiment shown, the hinge pin 102 comprises two mounting portions 132 and two securing portions 142. The mounting portions 132 have a smaller dimension $m_1$ in a first direction orthogonal to the longitudinal direction, and a larger dimension $m_2$ in the second direction orthogonal to the longitudinal direction. In the embodiment shown, the first direction extends orthogonally to the support surface of the crampon and thus, in the mounted state, substantially orthogonally to a ski surface. The second direction extends orthogonally to the first direction and in parallel with the support surface of the crampon and with the ski surface. The first and second direction do not have to be orthogonal to one another, but must differ from one another. The securing portions 142 have substantially the same dimension s in the first and in the second direction. In the embodiment shown, the cross section of the securing portions 142 is circular and the cross section of the mounting portions 132 are substantially rectangular. The smaller dimension $m_1$ of the mounting portions 132 in the first direction can be achieved in that, in the region of the mounting portions 132, the outer portions of the hinge pin 102 that is substantially circular over the remainder of the extension thereof, can be hollowed out, in particular milled out or removed in another manner.

The hinge pin 102 can be attached to the crampon body in a rotationally fixed manner, by means of screws, rivets, dowel pins, adhesive bonding, welding, interlocking connection, frictional connection, force fitting, or the like, or can be formed integrally with the crampon body.

Furthermore, the hinge pin 102 can comprise a centring portion 150 which can in particular be arranged in a centre of the hinge pin 102 and, in the embodiment of the invention, is formed as a notch 150, in which a complementary protrusion 50 (FIG. 2*a* to 5*c*), formed on the fastening assembly, can engage in order to retain the crampon 100 pivotably on the ski, and so as to be central with respect to a ski width.

FIG. 2*a* to 2*d* show a front unit 10 according to the embodiment of the invention, FIGS. 2*a* and 2*b* being perspective views of the front unit 10, FIG. 2*c* being a plan view of the front unit 10, and FIG. 2*d* being a side view of the front unit 10.

The front unit 10 comprises a base 12, arms, on which pins for coupling to a touring ski boot are provided, and an opening lever. The front unit 10 differs from conventional touring ski binding front units by a fastening assembly 20 which can be combined with front units for touring ski bindings of all kinds. The fastening assembly 20 comprises at least one mounting fastening portion 32 and at least one securing fastening portion 42. In the embodiment shown, the fastening assembly 20 comprises two mounting fastening portions 32 which are provided on a mounting fastening element 30, and two securing fastening portions 42 which are provided on a securing fastening element 40. The fastening assembly 20 will be discussed in greater detail in the following, with reference to FIG. 3*a* to 3*d* (fastening assembly 20). FIG. 4*a* to 4*c* (mounting fastening element 30 comprising mounting fastening portions 32), and FIG. 5*a* to 5*c* (securing fastening element 40 comprising securing fastening portions 42).

In the preferred embodiment shown, the mounting fastening element 30 of the fastening assembly 20 can comprise a fastening means 34 for fastening to the base 20 of the front unit. The fastening means 34 can be provided in the form of a hook 34 which can extend below and engage behind a rib 14 provided on the base 12. Alternatively, it is also possible to fasten the fastening assembly by means of binding mounting screws or by means of separately screwing the fastening assembly to the ski.

FIG. 3*a* to 3*d* show the fastening assembly 20 according to the embodiment of the invention in an assembled state, FIGS. 3*a* and 3*b* being perspective views of the fastening assembly 20, FIG. 3*c* being a plan view of the fastening assembly 20, and FIG. 3*d* being a side view of the fastening assembly 20.

FIG. 4*a* to 4*c* show the mounting fastening element 30 of the fastening assembly 20 according to the embodiment of the invention, comprising two mounting fastening portions 32, FIG. 4*a* being a perspective view of the mounting fastening element 30, FIG. 4*b* being a plan view of the mounting fastening element 30, and FIG. 4*c* being a side view of the mounting fastening element 30.

FIG. 5*a* to 5*c* show the securing fastening element 40 of the fastening assembly 20 according to the embodiment of the invention, comprising two securing fastening portions 42, FIG. 5*a* being a perspective view of the securing fastening element 40, FIG. 5*b* being a plan view of the securing fastening element 40, and FIG. 5*c* being a side view of the securing fastening element 40.

The fastening assembly 20 comprises the at least one mounting fastening portion 32 and the at least one securing fastening portion 42. In the preferred embodiment of the invention shown, as set out above with reference to FIG. 2*a* to 2*d*, the fastening assembly 20 comprises two mounting fastening portions 32 which are provided on the mounting fastening element 30, and two securing fastening portions 42 which are provided on the securing fastening element 40. Each of the mounting fastening portions 32 defines a gap 36 which extends in a direction extending substantially transversely to a ski longitudinal direction and so as to be substantially in parallel with a ski surface, and which is intended for receiving one of the mounting portions 132 of the hinge pin 102, in each case, and defining an opening 38 which extends in a direction extending substantially transversely to the ski longitudinal direction and so as to be substantially in parallel with the ski surface, and which is intended for insertion of one of the mounting portions 132, in each case, of the hinge pin 102 through the opening 38. The dimension $a_m$ in the ski longitudinal direction of the opening 38 of each of the mounting fastening portions 32 is larger than the dimension $m_1$ of each of the mounting portions 132 of the hinge pin 102 in the first direction, and smaller than the dimension $m_2$ of each of the mounting portions 132 of the hinge pin 102 in the second direction, such that, in a particular angular position, in which the smaller dimension $m_1$ of the mounting portion 132 passes through the opening 38, the hinge pin 102 can be inserted through the opening 38, into the crampon receptacle or the gap 36 defined by the mounting fastening portions 32.

Each of the securing fastening portions 42 defines a gap 46 which extends in a direction extending substantially transversely to the ski longitudinal direction and so as to be substantially in parallel with the ski surface, and which is intended for receiving the securing portion 142 of the hinge pin 102, and defining an opening 48 which extends in a direction extending substantially transversely to the ski longitudinal direction and so as to be substantially in parallel with the ski surface, and which is intended for insertion of the securing portion 142 of the hinge pin 102 through the opening 48. In this case, each of the securing fastening portions 42 are resiliently yielding at least in part. The dimension $a_s$ is smaller, in the ski longitudinal direction of the opening 48 of each of the securing fastening portions 42 is smaller than the dimension s of the securing portion 142 of the hinge pin 102, such that the securing portions 42 of the hinge pin 102 can be inserted through the opening 48 into the crampon receptacle or the gap 46 defined by the securing fastening portions 42 by application of force, and a resulting deformation of the resiliently yielding securing fastening portions 42.

The securing fastening element 40 can be fastened to the mounting fastening element 30. In the preferred embodiment, the securing fastening element 40 can be fastened to the mounting fastening element 30 in an interlocking manner. An interlocking fit between the mounting fastening element 30 and the securing fastening element 40 can be achieved for example by means of projections on the mounting fastening element 30 which, as can be seen for example in FIG. 3*c*, can surround outer edges of the securing fastening element 40. An inverted arrangement is also possible.

The fastening assembly 20 can furthermore comprise a centring portion 50 which can cooperate with the complementary portion 150 provided on the hinge pin 102, in order to hold the hinge pin 102 of the crampon 100 in the central position, with respect to the direction extending transversely to the ski longitudinal direction and in parallel with the ski surface. The centring portion 50 can be provided on the mounting fastening element 30 or on the securing fastening element 40. In the embodiment shown, the centring portion 50 is provided on the securing fastening element 40 and is designed as a protrusion 50 which can engage in the complementary notch 150 formed on the hinge pin 102 of the crampon 100 (FIG. 1*a* to 1*c*) in order to hold the crampon 100 on the ski so as to be central and pivotable with respect to the ski width.

In the preferred embodiment, the mounting fastening element 30 can in particular be made of metal, and the securing fastening element 40 can in particular be made of plastics material.

In this way, in the preferred embodiment of the fastening assembly 20 a retainer for the crampon 100 is provided, which, due to the shaping and the material selection of the mounting fastening element 30 provides stable guidance for the hinge pin 102 of the crampon 100 and, due to the shaping and material selection of the securing fastening element 40 provides an additional clip-like receptacle for the hinge pin 102 of the crampon 100 into which the hinge pin 102 can be clipped. This makes it possible to prevent the possibility of the crampon 100 being able to be removed from the fastening assembly 20 without force being applied.

An embodiment of the present invention has been described above, with reference to the accompanying drawings. The present invention is not, however, restricted to this embodiment, and a number of modifications can be made thereto, without deviating from the scope of the invention.

The invention claimed is:

1. A fastening assembly for a crampon that is to be coupled to a ski, the fastening assembly comprising:

at least one mounting fastening portion, wherein the at least one mounting fastening portion defines:

a first gap which extends in a direction extending substantially transversely to a ski longitudinal direction and so as to be substantially in parallel with a ski surface, and which is configured for receiving a mounting portion of a hinge pin of a crampon, and a first opening which extends in the direction extending substantially transversely to the ski longitudinal direction and so as to be substantially in parallel with the ski surface, and which is configured for insertion of the mounting portion of the hinge pin through the first opening, wherein a dimension of the first opening in the ski longitudinal direction is larger than a dimension of the mounting portion of the hinge pin in a first direction orthogonal to a longitudinal direction of the hinge pin, and smaller than the dimension of the mounting portion of the hinge pin in a second direction orthogonal to the longitudinal direction of the hinge pin; and at least one securing fastening portion, wherein the at least one securing fastening portion defines:

a second gap which extends in the direction extending substantially transversely to the ski longitudinal direction and so as to be substantially in parallel with the ski surface, and which is intended for receiving a securing portion of the hinge pin, and a second opening which extends in the direction extending substantially transversely to the ski longitudinal direction and so as to be substantially in parallel with the ski surface, and which is configured for insertion of the securing portion of the hinge pin through the second opening, wherein the at least one securing fastening portion is resiliently yielding at least in part, and wherein a dimension of the second opening in the ski longitudinal direction is smaller than a dimension of the securing portion of the hinge pin.

2. The fastening assembly of claim 1, wherein the fastening assembly comprises two mounting fastening portions which are provided on a mounting fastening element.

3. The fastening assembly of claim 1, wherein the fastening assembly comprises two second securing fastening portions which are provided on a securing fastening element.

4. The fastening assembly of claim 1, wherein the fastening assembly further comprises a centering portion designed for cooperating with a complementary portion provided on the hinge pin, in order to hold the hinge pin of the crampon in a central position with respect to the direction extending substantially transversely to the ski longitudinal direction and so as to be substantially in parallel with the ski surface.

5. The fastening assembly of claim 4, wherein the fastening assembly comprises two mounting fastening portions which are provided on a mounting fastening element, and wherein the centering portion is provided on the mounting fastening element.

6. The fastening assembly of claim 4, wherein the fastening assembly comprises two securing fastening portions which are provided on a securing fastening element, and wherein the centering portion is provided on the securing fastening element.

7. The fastening assembly of claim 1, wherein the at least one mounting fastening portion is made of a metal.

8. The fastening assembly of claim 1, wherein the at least one securing fastening portion is made of a plastics material.

9. The fastening assembly of claim 1, wherein the fastening assembly comprises two mounting fastening portions which are provided on a mounting fastening element, and wherein a securing fastening element is fastened to the mounting fastening element in an interlocking manner.

10. The fastening assembly of claim 1, wherein the fastening assembly is coupled to a front unit of a touring ski binding mounted on the ski.

11. The fastening assembly of claim 10, wherein the fastening assembly comprises two mounting fastening portions which are provided on a mounting fastening element; and wherein the mounting fastening element comprises at least one fastening means for fastening to a base of the front unit.

12. The fastening assembly of claim 11, wherein the at least one fastening means is provided in a form of a hook which is designed for extending below and engaging behind a rib provided on the base of the front unit.

13. The fastening assembly of claim 10, wherein the at least one mounting fastening portion is formed integrally with a base of the front unit.

14. The fastening assembly of claim 10, wherein the at least one securing fastening portion is formed integrally with a base of the front unit.

15. The fastening assembly of claim 10, further comprising the crampon;

wherein the crampon comprises the hinge pin, and wherein the mounting portion of the hinge pin, in the longitudinal direction of the hinge pin, has a smaller dimension in the first direction orthogonal to the longitudinal direction of the hinge pin, and a larger dimension in the second direction orthogonal to the longitudinal direction of the hinge pin, wherein the securing portion of the hinge pin has substantially the same dimensions in the first direction and in the second direction.

16. A front unit of a touring ski binding comprising:

a fastening assembly comprising at least one mounting fastening portion, wherein the at least one mounting fastening portion defines:

a first gap which extends in a direction extending substantially transversely to a ski longitudinal direction and so as to be substantially in parallel with a ski surface, and which is configured for receiving a mounting portion of a hinge pin of a crampon, and a first opening which extends in the direction extending substantially transversely to the ski longitudinal direction and so as to be substantially in parallel with the ski surface, and which is configured for insertion of the mounting portion of the hinge pin through the first opening, wherein a dimension of the first opening in the ski longitudinal direction is larger than a dimension of the mounting portion of the hinge pin in a first direction orthogonal to a longitudinal direction of the hinge pin, and smaller than the dimension of the mounting portion of the hinge pin in a second direction orthogonal to the longitudinal direction of the hinge pin; and at least one securing fastening portion, wherein the at least one securing fastening portion defines:

a second gap which extends in the direction extending substantially transversely to the ski longitudinal direction and so as to be substantially in parallel with the ski surface, and which is intended for receiving a securing portion of the hinge pin, and a second opening which extends in the direction extending substantially transversely to the ski longitudinal direction and so as to be substantially in parallel with the ski surface, and which is configured for insertion of the securing portion of the hinge pin through the second opening, wherein the at least one securing fastening portion is resiliently yielding at least in part, and wherein a dimension of the second opening in the ski longitudinal direction is smaller than a dimension of the securing portion of the hinge pin.

17. The front unit of claim 16, further comprising a base;

wherein the fastening assembly comprises two mounting fastening portions which are provided on a mounting fastening element; and wherein the mounting fastening element comprises at least one fastening means for fastening to the base of the front unit.

18. The front unit of claim 17, wherein the at least one fastening means comprises a hook which is designed for extending below and engaging behind a rib provided on the base of the front unit.

19. The front unit of claim 16, wherein the at least one mounting fastening portion is formed integrally with a base of the front unit.

20. The front unit of claim 16, wherein the at least one securing fastening portion is formed integrally with a base of the front unit.

21. The front unit of claim 16, further comprising the crampon;

wherein the crampon comprises the hinge pin, and wherein the mounting portion of the hinge pin, in the longitudinal direction of the hinge pin, has a smaller dimension in the first direction orthogonal to the longitudinal direction of the hinge pin, and a larger dimension in the second direction orthogonal to the longitudinal direction of the hinge pin, wherein the securing portion of the hinge pin has substantially the same dimensions in the first direction and in the second direction.

22. The front unit of claim 16, wherein the front unit is mounted on the ski.

* * * * *